US007562525B2

(12) United States Patent
Brockmann et al.

(10) Patent No.: US 7,562,525 B2
(45) Date of Patent: Jul. 21, 2009

(54) HYDRAULIC SYSTEM FOR UTILITY VEHICLES, IN PARTICULAR AGRICULTURAL TRACTORS

(75) Inventors: Andreas Brockmann, Bidingen (DE); Michael Martens, Marktoberdorf (DE)

(73) Assignee: AGCO GmbH (DE)

( * ) Notice: Subject to any disclaimer, the term of this patent is extended or adjusted under 35 U.S.C. 154(b) by 369 days.

(21) Appl. No.: 11/472,148

(22) Filed: Jun. 21, 2006

(65) Prior Publication Data

US 2007/0045032 A1 Mar. 1, 2007

(30) Foreign Application Priority Data

Aug. 30, 2005 (GB) ..... 0517698.7

(51) Int. Cl.
*F15B 11/16* (2006.01)
*E02F 9/22* (2006.01)

(52) U.S. Cl. ..... 60/422; 60/433

(58) Field of Classification Search ..... 60/422, 60/433, 452, 484
See application file for complete search history.

(56) References Cited

U.S. PATENT DOCUMENTS 4,813,235 A * 3/1989 Miller ..... 60/452
5,271,227 A * 12/1993 Akiyama et al. ..... 60/422
5,642,616 A * 7/1997 Park ..... 60/452
6,082,106 A 7/2000 Hamamoto
6,314,729 B1 * 11/2001 Crull et al. ..... 60/452
6,401,456 B1 * 6/2002 Moriya et al. ..... 60/433
6,405,529 B1 * 6/2002 Berg et al. ..... 60/422
6,874,318 B1 * 4/2005 MacLeod ..... 60/452

FOREIGN PATENT DOCUMENTS

GB 2406618 4/2005

OTHER PUBLICATIONS

UK Search Report for Application No. GB0517698.7 dated Nov. 18, 2005.

* cited by examiner

*Primary Examiner*—Thomas E Lazo

(57) ABSTRACT

Disclosed is a hydraulic system for utility vehicles, in particular agricultural tractors, for supplying primary and/or auxiliary pressure medium consumers with pressure medium, comprising a pump, sucking from a pressure medium tank, the pump being controlled as a function of the load pressure of the pressure medium consumers and supplying a pump pressure exceeding the load pressure by a predetermined control pressure differential. The hydraulic system produces a first control pressure differential for operating a primary pressure medium consumer and a second higher control pressure differential for operating an auxiliary pressure medium consumer. The hydraulic system obtains rapid response of an actuated primary pressure medium consumer and prevents, under certain conditions due to thermal expansion, pressure medium from flowing to the pressure and flow controller of the pump and possibly causing unwanted restriction of the pump.

1 Claim, 1 Drawing Sheet

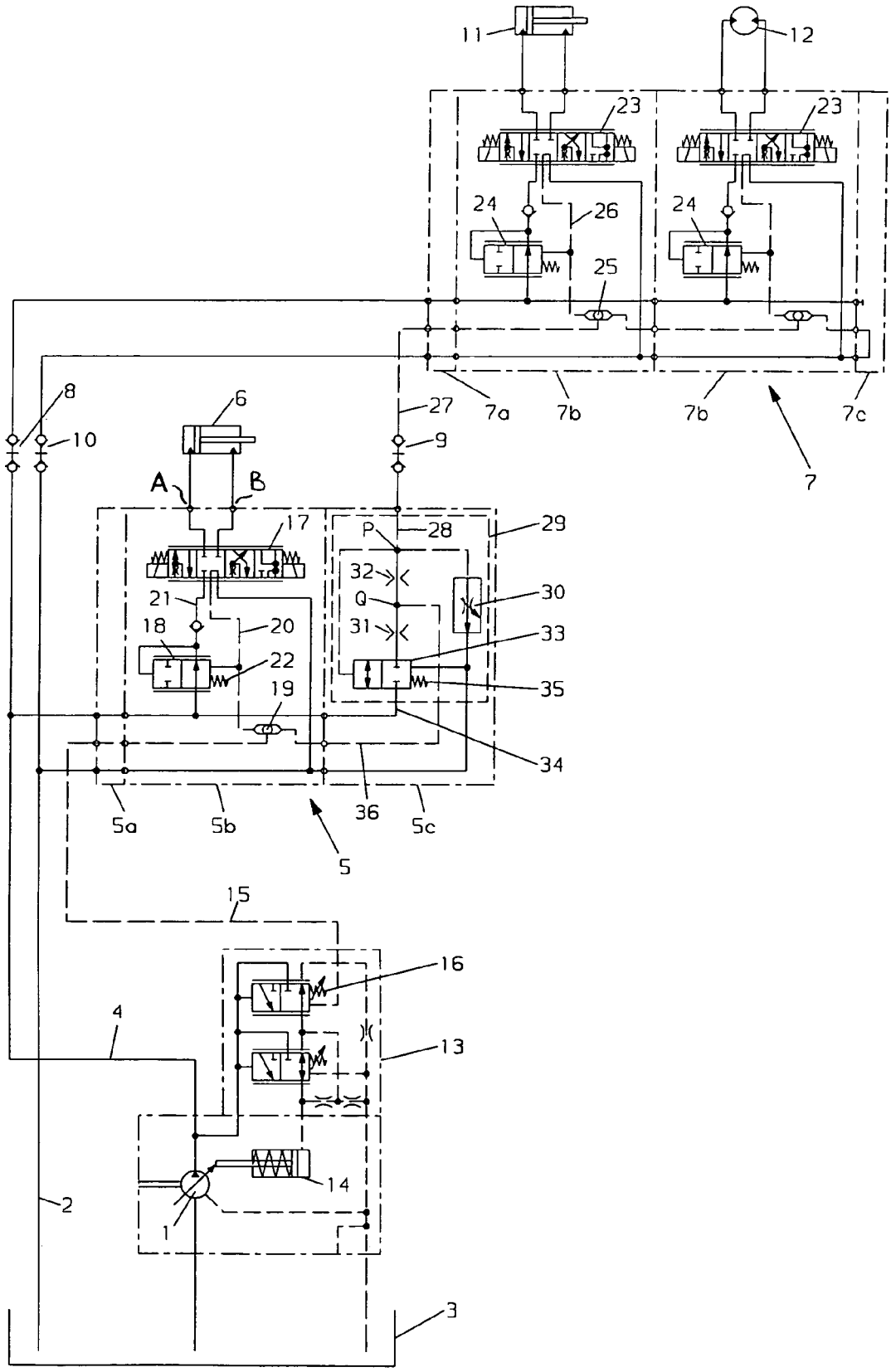
11
12
23
23
24
24
26
25
8
10
6
27
9
7a
7b
7b
7c
7
A
B
17
P
28
29
32
Q
30
21
31
33
18
20
22
35
19
34
5a
5b
36
5c
5
15
16
4
13
14
2
1
3

HYDRAULIC SYSTEM FOR UTILITY VEHICLES, IN PARTICULAR AGRICULTURAL TRACTORS

The Application is based on, and claims priority to, UK Application No. 0517698.7, filed Aug. 30, 2005.

BACKGROUND OF THE INVENTION

The invention relates to a hydraulic system for utility vehicles, in particular agricultural tractors, for supplying a load in the form of primary and/or auxiliary pressure medium consumers with pressure medium, comprising a pump sucking from a pressure medium tank, said pump being controlled as a function of the load pressure of the pressure medium consumers and supplying a pump pressure exceeding the load pressure by a predetermined control pressure differential, whereby in order to produce a first control pressure differential for operating a primary pressure medium consumer its load pressure acts upon the pressure and flow controller of the pump and in order to produce a second, higher control pressure differential for operating an auxiliary pressure medium consumer a pressure exceeding its load pressure is produced by means of an amplifying circuit, in which two orifices and a pressure regulator are arranged in a line between a load pressure reporting line and a pressure pipe of the pump; said pressure regulator is operated in the opening direction by the load pressure of an auxiliary pressure medium consumer and the increased pressure in the line between the orifices acts upon the pressure and flow controller.

European Patent EP 10 70 852 A2 describes such hydraulic system with a fixed displacement pump. Assigned to that pump is a device consisting of a pressure control valve with an inlet for an actuating pressure that enables the pump to deliver pressure medium to the pressure medium consumers at a necessary pressure and (flow) output. In the case of this system, for operating both the vehicle external (hereafter: primary and auxiliary) pressure medium consumers, the actuating pressure for the pressure control valve of the pump is picked up between the two orifices of the amplifying circuit. In order to provide different control pressures as they are needed to produce the various control pressure differentials for these pressure medium consumers, the line containing the orifices is blocked off by means of an additional pressure regulator, whenever a primary pressure medium consumer is in operation and open whenever an auxiliary pressure medium consumer is in operation. A disadvantage here is that the load pressure of the primary pressure medium consumers, which is utilized as actuating pressure for operating said pressure medium consumers is subject to restriction when passing through one of the orifices. As a consequence the actuating pressure takes longer to build up and the system dynamics are lower as a result.

A further disadvantage of the prior art hydraulic system is apparent if no implement is mounted on the vehicle, i.e. no auxiliary pressure medium consumer is connected to the hydraulic system of the vehicle. In this case it is possible that due to thermal expansion of the pressure medium inside the load pressure line for auxiliary pressure medium consumers or due to a leakage in the pressure regulator adjacent to the orifices, pressure medium flows to the pressure control of the pump. The effect of this is automatic restriction of the pump even as far as actuation of the assigned pressure relief valve (pump short-circuit).

The object of the invention is seen as providing a hydraulic system of the type mentioned at the beginning, wherein the disadvantages described are eliminated and which in particular without any time delay makes available the load pressure of a primary pressure medium consumer as actuating pressure for the device assigned to the pump.

BRIEF SUMMARY OF THE INVENTION

This object is achieved by the fact that the load pressure of a primary pressure medium consumer and the pressure supplied by the amplifying circuit can be fed via a shuttle valve to the pressure and flow controller of the pump and that a line conducting the load pressure of an auxiliary pressure medium consumer is connected via a flow control valve to the pressure medium tank.

As a result of this arrangement it is possible to keep the cost of the amplifying circuit to a minimum, since now only one pressure regulator is required to make available the control pressure differential needed for operating the primary or auxiliary pressure medium consumers respectively. Since the load pressure of the primary pressure medium consumers is not conducted via an orifice of the amplifying circuit, but is supplied directly to the pressure and flow controller of the pump without manipulation, whenever a primary pressure medium consumer is actuated the pump responds with rapid pressure build-up and delay-free supply of the necessary pressure medium. In this case the flow control valve reliably prevents pressure from building up in the amplifying circuit due for example to thermal expansion of the pressure medium, which may affect the pressure and flow controller of the pump in an undesirable way.

BRIEF DESCRIPTION OF THE DRAWING

The invention is described below in detail on the basis of a drawing showing a circuit diagram for a hydraulic system.

DETAILED DESCRIPTION OF THE INVENTION

In the circuit diagram for a hydraulic system of an agricultural tractor, a variable volume displacement pump referenced with 1 sucks pressure medium via a suction line from a pressure medium tank 3 and supplies this via a pressure pipe 4 to a tractor-mounted control block 5. From here the pressure medium is distributed to primary pressure medium consumers 6, directly connected to the hydraulic system. The pressure medium is further distributed to auxiliary pressure medium consumers 11, 12 by means of an auxiliary control block 7, connected with hydraulic couplings 8, 9, 10 to the hydraulic system of the tractor. "Pressure medium consumers" here are understood as single and double acting hydraulic actuators (linear actuators and rotating actuators) for driving different implements such as, for example, the primary cylinder of the 3-point linkage for implements or an auxiliary actuating cylinder of an externally mounted front loader.

A pressure and a flow controller 13 is mounted on the pump 1, the purpose of that device consists in controlling, via an adjustment piston 14, the flow rate of the pump 1 as a function of the load pressure of the operating pressure medium consumers (communicated via a load pressure reporting line 15) in such a way that a defined pressure gradient, also called control pressure differential, always prevails between the pressure pipe 4 and the load pressure reporting line 15. The pressure gradient of approx. 20 bar required for operating primary pressure medium consumers 6 is adjusted by pretensioning a compression spring 16. In all other respects such a pressure and flow controller 13 is presumed to be familiar and therefore is not described in detail.

The primary control block 5 consists of an inlet section 5*a*, a valve section 5*b* and a sealing plate 5*c*, which are all bolted together to form a unit. Several valve sections 5*b* can be provided depending on the number of pressure medium consumers 6 to be operated.

The valve section 5*b* contains a solenoid-operated main slide valve 17 of the load pressure sensing type, a section pressure regulator 18 and a shuttle valve 19. The primary pressure medium consumer 6 is connected to the connections A and B communicating with the main slide valve 17. Its load pressure is supplied to the pressure and flow controller 13 via load pressure reporting line 20, shuttle valve 19 and load pressure reporting line 15. The section pressure regulator 18 lies in a pressure pipe 21 leading to the main slide valve 17 and by the corresponding pre-tensioning of a spring 22 permits a desired pressure gradient to be adjusted between the pressure pipe 21 and the load pressure reporting line 20. Customary values for the pressure gradient are approx. 8 bar. Therefore a pressure differential of approx. 12 bar is available to compensate for any flow losses between the pump 1 and the valve section 5*b*. Such adjustment of the pressure gradient ensures low-loss and reliable operation of all primary pressure medium consumers 6 connected to the valve sections 5*b*.

The auxiliary control block 7 is arranged on an implement, a potato digger for example, and consists of an inlet section 7*a* as well as several valve sections 7*b*, whereby a valve section 7*b* is present for each pressure medium consumer 11, 12 operated with the implement. Each auxiliary valve section 7*b* includes a section pressure regulator 24 with a solenoid-operated main slide valve 23 of the load pressure sensing type, and a shuttle valve 25 similar in design and operation to that of a primary valve section 5*b*. Load pressure reporting lines 26 leading from the main slide valves 23 conduct the highest occurring load pressure of the auxiliary pressure medium consumers 11, 12 via shuttle valves 25 to the auxiliary load pressure reporting line 27, which leads to the hydraulic coupling 9.

A primary load pressure reporting line 28, which supplies the load pressure of the auxiliary pressure medium consumer 11, 12 to an amplifying circuit 29, begins there. It ends inside the sealing plate at the junction P. A line, which contains a flow control valve 30 set to a nominal flow-rate of approx. 0.3 litres per minute, connected to the return pipe 2 leading to the pressure medium tank 3 runs out from this junction P. In addition a line, in which two orifices 32, 31 and a pressure regulator 33 lie one behind the other, runs from the junction P. The pressure regulator 33 as a function of the load pressure in the load pressure reporting line 28 controls the flow of pressure medium from an extension 34 of the pressure pipe 4 to the orifices 31, 32, conducting the actual pump pressure. The pressure regulator 33 can be adjusted by means of a spring 35 so that it closes with a load pressure of less than 3 to 4 bar and only starts to open when the load pressure rises again. Between the orifices 31, 32 a load pressure reporting line 36 leading to the shuttle valve 19 branches off from the line at the junction Q, from where the load pressure reporting line 15 leads to the pressure and flow controller 13.

By definition a pressure gradient of 20 bar always prevails between the extension 34 of the pressure pipe 4 and the load pressure reporting line 15. Since the load pressure reporting line 15 is connected via the load pressure reporting line 36 to the junction Q, accordingly a pressure gradient of 20 bar must prevail across orifice 31. The orifice 31 is designed so that a pressure flow rate of approx. 1 to 1.5 litres per minute is attained. This flow rate is divided at the junction P so that one part flows via the flow control valve 34 to the pressure medium tank 3. The remainder flows via the primary load pressure reporting line 28, hydraulic coupling 9, load pressure reporting line 27, shuttle valve 25 and load pressure reporting line 26 to the main slide valve 23. As a result of the pressure gradient building up through the orifice 32 as well as the lines 28, 27, 26 up to the main slide valve 23 the pressure in the junction Q increases accordingly. Orifice 32 is designed so that this pressure gradient corresponds to the desired control pressure amplification. The pressure at the junction Q is supplied to the pressure and flow controller 13 as available load pressure via the load pressure reporting line 36, 15. Whenever an auxiliary pressure medium consumer 11, 12 is actuated, an artificially increased load pressure is reported to the pressure and flow controller 13. This ensures that the pump 1 produces a substantially greater pressure gradient compared to when a primary pressure medium consumer 6 is actuated, for example 30 bar, between the pressure pipe 4 and the load pressure reporting line 15 so that despite higher pressure losses in the pressure pipe leading to the auxiliary pressure medium consumers 11, 12 fed via the hydraulic coupling 8, the latter are supplied with the required operating pressure.

The invention has been described on the basis of a hydraulic system with a variable volume displacement pume. Should the invention be used in conduction with a fixed displacement pump then there is nothing to do but to connect the pressure reporting line 15 to the corresponding inlet of the pressure and flow controller of the fixed displacement pump. Such pressure and flow controllers are well known therefore a closer description thereof is unnecessary.

The invention claimed is:

1. A hydraulic system for utility vehicles, in particular agricultural tractors, for supplying one or more primary pressure medium consumers (6) with pressure medium via one or more first slide valves (17) and one or more auxiliary pressure medium consumers (11, 12) with pressure medium via one or more second slide valves (23), the system comprising a pump (1) sucking from a pressure medium tank (3), the pressure of said pressure medium being controlled as a function of the load pressure of the pressure medium consumers and supplying a pump pressure exceeding the load pressure by a predetermined control pressure differential, whereby in order to produce a first control pressure differential for operating primary pressure medium consumers (6) the pump load pressure acts upon a pressure and flow controller (13) assigned to the pump and in order to produce a second higher control pressure differential for operating auxiliary pressure medium consumers (11, 12) a pressure exceeding their load pressure is produced by means of an amplifying circuit (29) in which two orifices (32, 31) and a pressure regulator (33) are arranged in a line (34) which supplies fluid from the pump to the second slide valve (23), the pressure regulator (33) being operated in the opening direction by the load pressure of an auxiliary pressure medium consumers (11, 12) and the increased pressure in the line between the orifices acting upon the pressure and flow controller (13), the load pressure of a primary pressure medium consumer (6) and the pressure supplied by the amplifying circuit (29) being fed via a shuttle valve (19) to the pressure and flow controller (13) of the pump (1), and a load pressure reporting line (28) conducting the load pressure of an auxiliary pressure medium consumers (11, 12) to the pressure medium tank (3) via a flow control valve (30).

* * * * *